United States Patent [19]

Sekiya et al.

[11] Patent Number: 5,036,689

[45] Date of Patent: Aug. 6, 1991

[54] DESCALING ROLLED MATERIAL

[75] Inventors: Teruo Sekiya, Takahagi; Tomoaki Kimura, Hitachi, both of Japan

[73] Assignee: Hitachi, Ltd., Tokyo, Japan

[21] Appl. No.: 409,155

[22] Filed: Sep. 19, 1989

[30] Foreign Application Priority Data

Sep. 20, 1988 [JP] Japan ..... 63-235936

[51] Int. Cl.[5] ..... B21B 45/04

[52] U.S. Cl. ..... 72/39; 29/81.08

[58] Field of Search ..... 29/81 R, 81 A, 81 B, 29/81.01, 81.06, 81.08, 81.03; 72/39, 40; 134/15, 16

[56] References Cited

U.S. PATENT DOCUMENTS

| | | | |
|---|---|---|---|
| 2,824,321 | 2/1958 | Bandy | 29/81 A X |
| 2,937,431 | 5/1960 | Bongiovanni | 29/81 A |
| 4,793,168 | 12/1988 | Kumura | 72/40 |

FOREIGN PATENT DOCUMENTS

| | | | |
|---|---|---|---|
| 51-31637 | 3/1976 | Japan | 72/39 |
| 51-86029 | 7/1976 | Japan | 72/39 |
| 55-5156 | 1/1980 | Japan | 72/40 |
| 60-71416 | 3/1985 | Japan . | |
| 61-269925 | 11/1986 | Japan | 72/39 |
| 63-68213 | 3/1988 | Japan | 72/39 |
| 63-104724 | 5/1988 | Japan | 72/39 |
| 923997 | 4/1963 | United Kingdom | 29/81 A |

*Primary Examiner*—E. Michael Combs

*Attorney, Agent, or Firm*—Fay, Sharpe, Beall, Fagan, Minnich & McKee

[57] ABSTRACT

When a strip of e.g. hot steel is rolled by a rolling or roughing mill, scale develops on the surface of the strip which must be removed. The strip is passed over a bending roller which bends the strip and causes cracks in the scale. Then water is injected onto the strip to wash the roller and lift of the scale. Inertia then causes the water and scale to leave the surface of the strip and pass to a collection device whose water collecting surface is out of contact with the strip and on the opposite side of the bending roller from where the water is injected. In this way the time of contact of the water with the strip can be kept short and the strip is not damaged by contact with the collection device.

22 Claims, 4 Drawing Sheets

DESCALING ROLLED MATERIAL

Background of the Invention

1. Field of the Invention

The present invention relates to the descaling of rolled material (for example, steel) which may be produced by e.g. a hot strip rolling mill. The present invention relates to both the method and apparatus aspects of descaling.

2. Summary of the Prior Art

It is well known to use a hot strip rolling mill to produce rolled material. A conventional hot strip rolling mill is shown in FIG. 7 of the accompanying drawings, in which the material passes first through roughing mills 50, which provide preliminary milling, and finishing mills 51 which complete the milling. On the material entry side of the roughing mills 50, and also on the material entry side of the finishing mills 51, are descaling headers 52, the purpose of which is to remove scale from the surface of the rolled material as will be described subsequently. As illustrated in FIG. 7, there are a pair of the descaling headers 52 arranged at the entry side of the finishing mills 51, which together with pinch rollers 54 and 55 form a descaling device 53, which is shown in FIG. 8.

In the descaling device 53, a strip 56 of the hot rolled material passes between the pinch rollers 54, 55, and between the descaling headers 52. FIG. 8 also illustrates that the descaling headers 52 arranged adjacent table rollers 57, and water collecting devices each provided with a water collecting plate 58, arranged above the table rollers 57. Water pressurised to about 100 to 150 kg/cm2 is injected from the descaling headers 52 on to the strip 56 of rolled material, which loosens the scale on the strip 56. Water and scale on the upper surface of the strip 56 is then collected by the water collecting devices 58.

However, as illustrated in FIG. 7, there may be as many as six or seven finishings mills 51 in a hot strip mill, and therefore the thickness of the strip of hot rolled material at the entry side of the series of finishings mills 51 is relatively large, for example about 20 to 30 mm. Recently, however, "mini" hot strip mills have been developed in which the length of the rolling line is shortened so as to minimise the extent of the apparatus. In such a mini hot strip mill, the thickness of the strip of rolled material at the entry side of the finishing mill is relatively small, e.g. about 8 to 15 mm, and the number of finishing mills is only three or four. The rolling speed is relatively low because the finishing mills are directly connected to a continuous casting machine.

The descaling device shown in FIG. 8 was developed for a standard hot strip mill, such as that shown in FIG. 7, and it is thought that if it is applied to a mini hot strip mill, operating at low speed, there would be a large temperature drop in the rolled material due to the injection of a large amount of water at high pressure. Since this occurs before the finishing mills, the cooling may make rolling more difficult, or impossible, and the reduction in temperature will inevitably increase the production costs.

It is necessary for the descaling device shown in FIG. 8 to inject water at high pressure in order to remove scale as discussed above, but little thought is given to what happens to the water after that. In a conventional hot strip rolling mill, the thickness of the rolled material means that the problem with temperature reduction is not acute. In a mini hot strip mill, excessive cooling is likely to occur because the the water remains in contact with the rolled material, and because the water collecting efficiency is reduced by water leaks from the space between the rolled material and the water collecting plates.

There is the further problem that the water collecting plates 58 contact the rolled material, and flaws may thereby be generated, particularly in the case where the rolled material is thin such as when the material is being rolled by a mini hot strip mill.

An alternative method of removing scale from a hot rolled material uses a wire brush, instead of a descaling header which injects water under pressure, and an example of such an arrangement is shown by Japanese Utility Model Laid-Open Application No. 60-71416. The use of a wire brush roller to remove scale does not suffer from the disadvantage of causing a substantial reduction in the temperature of the rolled material, but it is found that it is difficult to achieve efficient scale removal, due to abrasion and deformation of the wire brush forming the roller that removes the scale. It is therefore necessary to frequently exchange the wire brush in order to maintain efficiency, and this creates a disadvantage in cost.

It is also known to inject water under pressure from the descaling headers onto a part of the rolled material in contact with a bending tool, such as a roller, so that the bending opens cracks in the scale that the water can enter and so assist in the scale removal. Examples of such an arrangement are shown in Japanese Patent Laid-Open Application Nos. 55-5156 and 61-269925. In each of these documents, it is important to note that the water is injected at the point of bending. However, where the rolled material is bent and pressurized water injected, effective descaling can be achieved at lower pressures than the standard method as discussed with reference to FIGS. 7 and 8, but removal of the injected pressurized water is not considered in either of these prior art documents so it remains on the roller material. As a result, in a mini hot strip mill, there can be a significant temperature drop in the rolled material.

SUMMARY OF THE INVENTION

The present invention seeks to overcome, or at least ameliorate, the problems associated with the known descaling devices discussed above. In general terms, the present invention proposes that water be injected onto the rolled material prior to it being bent, and then collected after the point of bending.

In the present invention, the surface of the rolled material opposite to the bending tool (normally a bending roller) is put under tension and therefore small cracks are generated on the layer of scale on the surface of the rolled material. A part of that scale is exfoliated and lifted, and therefore pressurised water can remove the scale with only a small force being needed. As a result, the pressure and amount of water can be reduced, as compared with the known arrangements.

Furthermore, since the water is injected at a point spaced from the point of bending, and is directed towards the point of bending, water that is on the surface of the roller material will leave that surface at the point of bending due to inertia, and therefore can be efficiently collected by a water collecting device on the opposite side of the bend. As a result, the length of rolled material which is in contact with the water can be kept small. In prior art arrangements in which water is injected at the point of bending, some water inevitably remains on the rolled material downstream from the bending point.

Since inertia causes the water to leave the surface of the rolled material, the easiest way of collecting that water and the scale, is to arrange a water reception surface of a suitable collecting device, adjacent, but spaced from the rolled material. Unlike other prior art arrangements, the fact that the water leaves the surface enables the water collection surface to be spaced from the rolled material which prevents contact damage to that surface. That water collection surface should also be close (e.g. 100 mm) to the point of bending.

Since the pressure and the amount of water, and the length of time which the water is in contact with the rolled material is small, as compared with the known arrangements, there is no significant temperature drop in the rolled material. As a result, if it is used to form part of a descaling device on the entry side of finishing rollers in a mini hot strip mill, the efficiency of the rolling can be maintained.

Preferably, means are provided for withdrawing the bending means (bending roller) and the water collection device from adjacent the strip of rolled material. This feature may be developed further, in arrangements of the present invention in which two descaling devices are provided, to remove scale from opposite surfaces of the strip of rolled material. In this case, the bending device (bending roller) of one descaling device and the water collection device of the other descaling device may be interconnected so that they may simultaneously be withdrawn from the strip of rolled material.

BRIEF DESCRIPTION OF THE DRAWINGS

Embodiments of the invention will now be described in detail, by way of example, with reference to the accompanying drawings in which.

DETAILED DESCRIPTION

Figure 1:
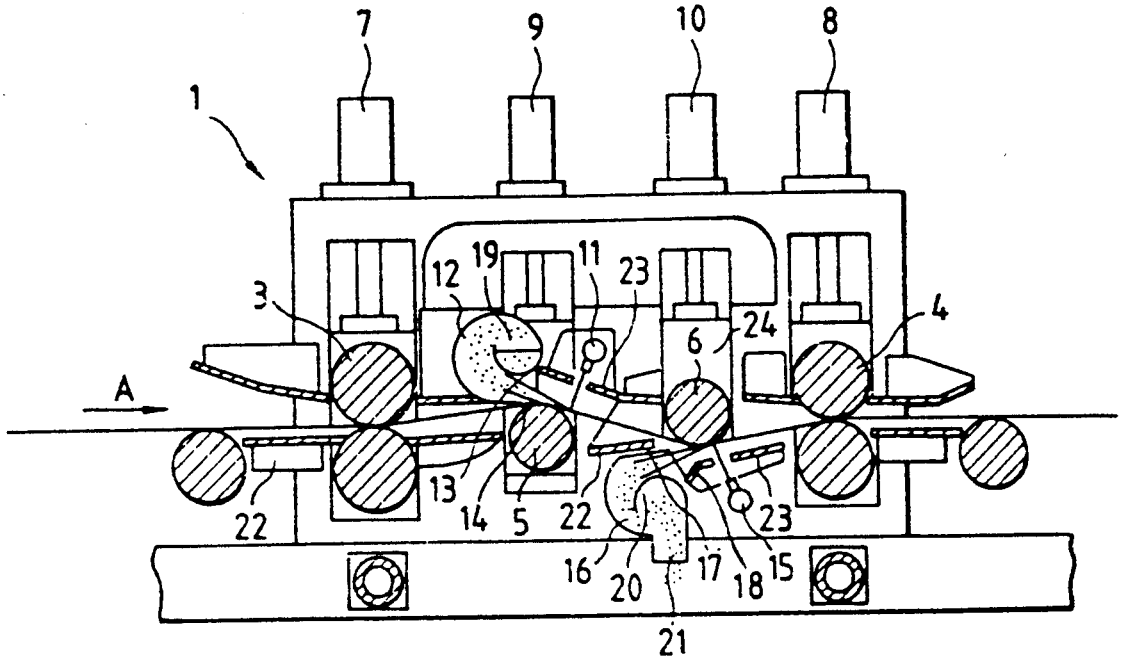
FIG. 1 shows a descaling device according to a first embodiment of the present invention.

Referring first to FIG. 1, a descaling device 1 being a preferred embodiment of the present invention has an inlet pinch roller 3 and an outlet pinch roller 4 through which a strip 2 of hot rolled steel is passed. Between the inlet pinch roller and the outlet pinch roller 4 are an inlet bending roller 5 and an outlet bending roller 6 which act as bending devices for bending a strip 2 of rolled steel. The lower rollers of the inlet pinch roller 3 and the outlet pinch roller 4 are fixed, and the upper rollers are supported by cylinders 7 and 8, respectively, so that they can be raised or lowered. Similarly, bending rollers 5 and 6 are supported by cylinders 9 and 10 respectively, so that they can be raised and lowered. As shown in FIG. 1, the inlet bending roller 5 can be raised slightly higher than the "nips" between the pinch rollers 3 and 4, so that the rolled steel strip 2 passing over it is bent, and tension is generated on the upper surface of the strip 2. Similarly, the outlet bending roller 6 is a little lower than the horizontal line between the "nips" between the pinch rollers 3 and 4, so that the rolled steel strip 2 is bent downwardly and tension is generated on the lower surface of the strip 2.

An upper descaling header 11 for injecting pressurized water on to the surface of the strip 2 is placed on the exit side of the bending roller 5, and an upper water collecting device 12 having a water collecting surface 13 which extends to a leading edge 14 immediately adjacent, but spaced from the strip 2, is positioned on the entry side of the roller 5. Similarly, a lower descaling header 15 and a lower water collecting unit 16 (with water collecting surface 17 having leading edge 18) is provided on opposite sides of the bending roller 6, exactly as header 11 and collecting device 12, but on the opposite side of the strip. The headers 11, 15 are arranged to inject water onto the strip 2 in a direction towards the corresponding bending roller 5, 6.

As illustrated in FIG. 1, the water collecting devices 12 and 16 have a spiral cross-section from their leading edges 14, 18, terminating in curved parts 19, 20 which receive the water, and lead to an outlet. That outlet is not shown in the case of the water collecting unit 12, but is shown at 21 for the water collecting unit 16.

A plurality of guides 22 and projections 23 are arranged adjacent the strip 2, those guides 22 and projection 23 which are positioned at the front and rear of the bending roller 6 being connected to a supporting body 24 of that bending roller 6, so that they can be raised and lowered with bending roller 6 by cylinder 10. A cover (not shown) may be located above the inlet and outlet bending rollers 5 and 6 respectively.

Figure 2:
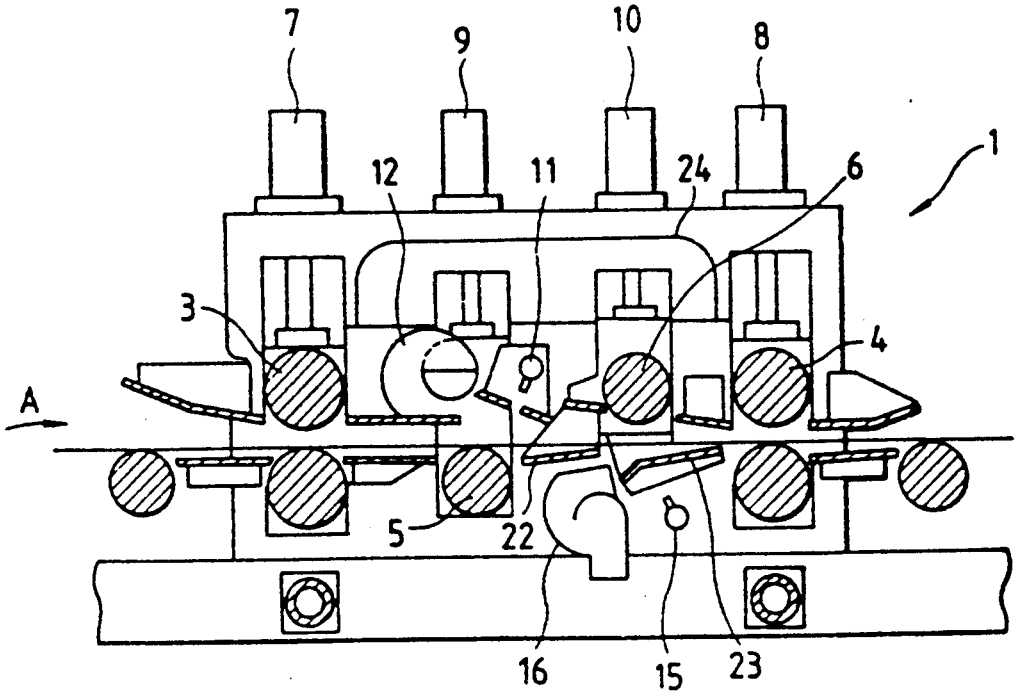
FIG. 2 shows the descaling device of FIG. 1 in a non-operative position.

When the strip 2 of hot rolled steel is first sent to the descaling device 1, the pinch rollers 3 and 4 are opened as shown in FIG. 2, and the bending rollers 5 and 6 are respectively lowered and raised to their withdrawn positions, so that the strip 2 may pass directly through the descaling device in the direction of arrow A. In the position shown in FIG. 2, it can be seen that the guides 22 and projections 23 are also raised, so that they provide a guide for the strip 2.

Then, the pinch rollers 3 and 4 are closed immediately after the tip of the strip 2 has passed the outlet pinch rollers 4, and then the bending rollers 5 and 6 are respectively raised and lowered by cylinders 9 and 10 to their working positions shown in FIG. 1, in which the strip 2 is bent by bending rollers 5 and 6. Pressurized water is then injected from the descaling headers 11 and 15, to mix with the scale, and the mixture of water and scale is collected by the water collecting devices 12 and 16. The cover prevents spray from scattering into the rest of the system.

Figure 8:
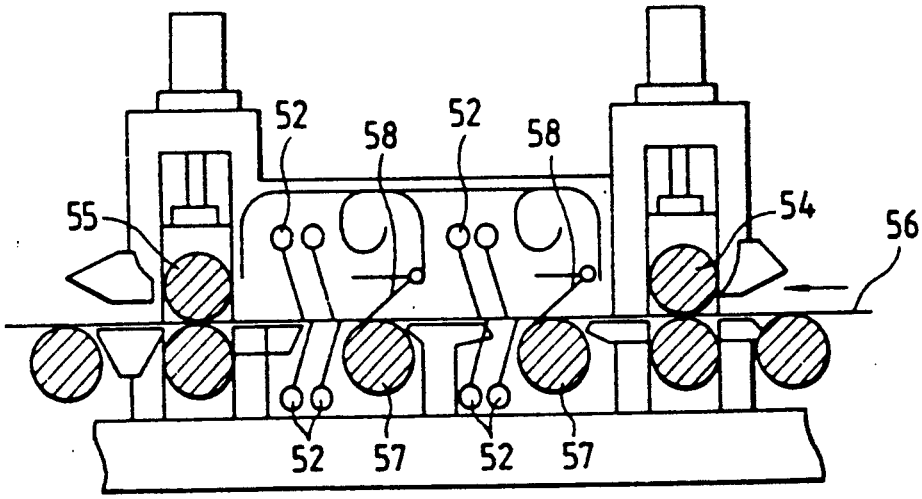
FIG. 8 shows a known descaling device, and again has already been described.

It should be noted that the pressurised water is injected immediately after the bending of the strip 2 of rolled steel, since then the tension created on the surface of the strip 2 opposite to the bending rollers 5 and 6 generates small cracks which are exfoliated and lifted by the water. Since that tension assists in this operation, the pressure of the water need not be large, and the amount of water injected can be less than in the known arrangement discussed with reference to FIG. 8. However, the pressure must be sufficient to ensure that the water flows towards the bent part of the strip 2 (i.e. in the opposite direction to movement of the strip 2) so that its inertia causes it to separate from the strip 2 at the bend. Hence, the length of strip 2 over which the water is in contact can be kept short, and by placing the leading edge 14, 18 of the water reception surface of each collection device 12, 16 close to the point of bending (e.g. within 100 mm) substantially all of the water can be collected.

Therefore, in this preferred embodiment, the pressure and amount of water injected from the descaling headers 11 and 15 is small, and the time of contact of water with the strip 2 is short, and therefore any temperature drop in the strip 2 (assuming that strip 2 is hot rolled steel) can be kept small, even if the strip 2 is moving at low speed. Furthermore, as the pressure and amount of water is reduced, the cost can also be reduced.

It can also be seen that as the leading edges 14, 18, of the water collection surfaces of the water collecting devices 12 and 16, are spaced from the strip 2, flaws in the rolled steel due to contact can be prevented. It can also be seen in FIG. 1 that the inlet roller 5, the descaling header 11 and the water collecting device 12 form a unit, as does the outlet bending roller 6, the descaling header 15 and the water collecting units 16. If scale exfoliated by bending reaches the next bending roller, the scale is forced into contact with that roller and the scale may be forced back into the strip 2 due to contact pressure generated between the roller and strip. This reduces the descaling performance. Therefore, it is important that the inlet bending roller 5, and the associated header 11 and collection device 12 remove scale from the upper surface before it reaches the outlet bending roller 6, so that the above problem can be eliminated.

Figure 3:
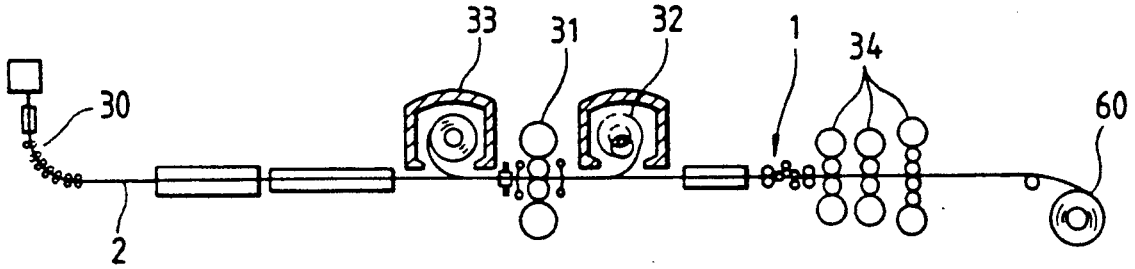
FIG. 3 shows the positioning of a descaling device according to FIGS. 1 and 2 in a rolling mill.

FIG. 3 shows the application of the descaling device of FIGS. 1 and 2 to a mini hot strip mill. A strip of hot steel is produced by a rapid casting machine 30 and passes to a roughing mill 31, so that it has a thickness of about 30 to 40 mm. In this state it is passed between coilers 32, 33 on opposite sides of the roughing mill 31, and passed repeatedly between those coilers 32, 31, and hence the roughing mill 31 until it has been rolled to a suitable thickness. Then, the strip passes to a finishing mill 34 and then to a final coiler 60. In the arrangements shown in FIG. 3, the descaling device 1 according to the present invention is arranged on the entry side of the finishing mill 34. The thickness of the strip of hot rolled steel at this point is relatively thin, e.g. about 8 to 15 mm, but even with a thicker material, effective scale removal with a small temperature drop can be achieved. Therefore, the strip of hot rolled steel reaches the finishing mills 34 at a sufficiently high temperature to achieve suitable milling.

Figure 4:
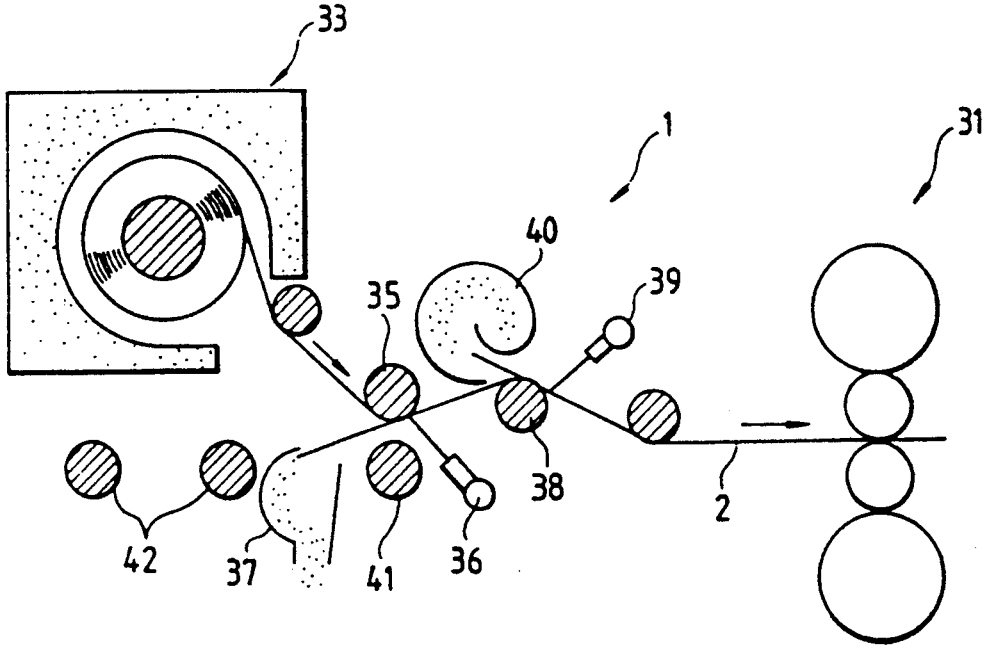
FIG. 4 shows a descaling device according to the present invention mounted in an alternative position in the rolling mill of FIG. 3.

The arrangement illustrated in FIG. 3 shows the descaling device 1 positioned on the entry side of the finishing mill 34. It is also possible to mount the descaling device 1 between the roughing mill 31 and one of the coilers 32 or 33, as is illustrated in FIG. 4. In that Figure only the key features of the descaling device are illustrated; other features may be the same as the embodiment shown in FIGS. 1 and 2.

In the descaling device 1 shown in FIG. 4, the strip 2 passing from the coil 33 is bent around a first bending roller 35, and water is injected onto the strip 2 from a first descaling header 36. The water from that descaling header passes to a water collection device 37. Similarly, the strip 2 is bent in the opposite direction by a second bending roller 38; water is injected via a second descaling header 39; and that water is collected by a second collection device 40. The assembly formed by each collection device 35, 38, corresponding descaling header 36, 39, and corresponding water collection device 37, 40 may be structurally similar to that shown in FIGS. 1 and 2. However, as illustrated in FIG. 4, at least one bending device may be formed from a pinch roller, comprising the bending roller 35 and a further roller 41. Rollers 42 illustrated in FIG. 4 are guide rollers as the strip 2 passes from the casting machine 30 to the roughing mill 31, prior to being wrapped around coilers 32 and 33.

Figure 5:
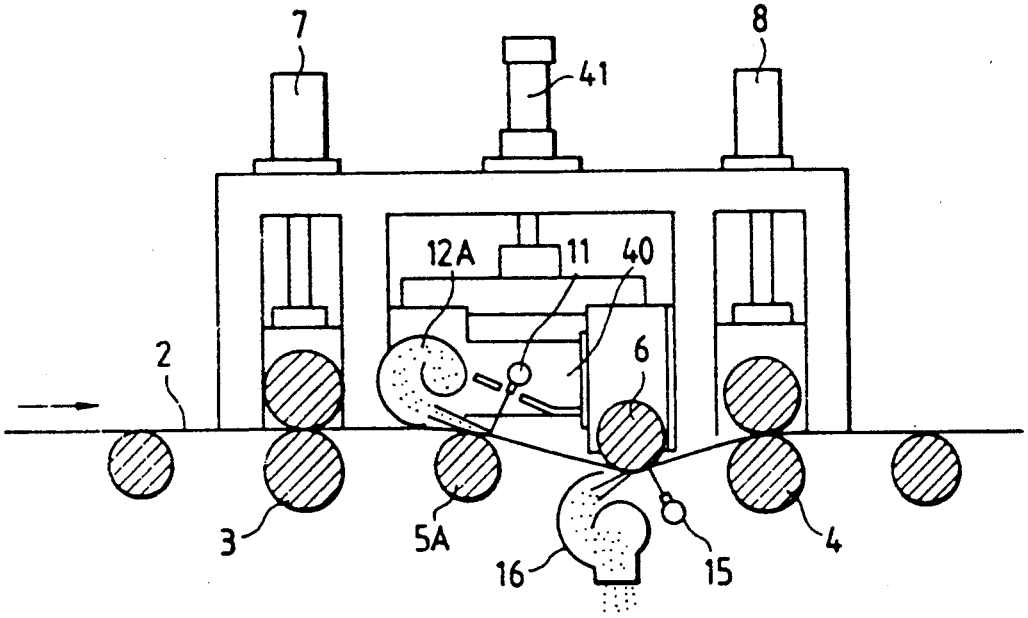
FIG. 5 shows a second embodiment of a descaling device according to the present invention.
Figure 6:
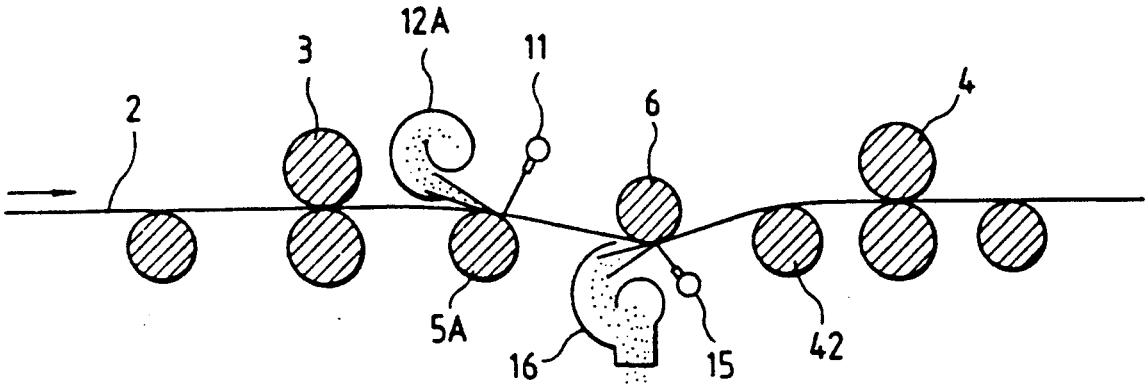
FIG. 6 shows a part of a further embodiment of the present invention, being a variation of that shown in FIG. 5.
Figure 7:
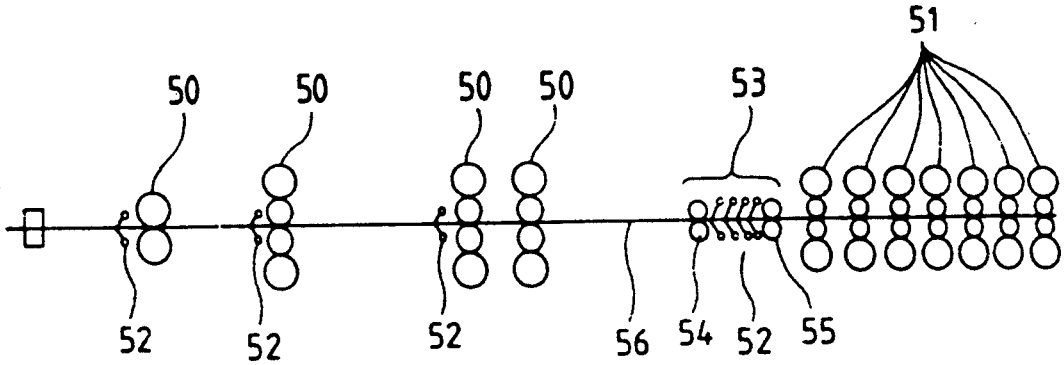
FIG. 7 shows a known rolling mill and, as has already been described.

Another embodiment of the invention will now be described with reference to FIGS. 5 and 6. The descaling device shown in FIGS. 5 and 6 is generally similar to that shown in FIGS. 1 and 2, except that the inlet bending roller 5*a* is fixed and only the outlet bending roller 6 can be raised and lowered. In this embodiment, the upper water collecting device 12*a*, which operates in conjunction with the bending roller 5*a* and descaling header 11, is connected to the outlet roller 6 through a frame 40. When the outlet roller 6 is lowered, not only does it bend the strip 2 around itself, but also causes the strip to bend around the inlet bending roller 5*a*, so that a similar effect to the embodiment of FIGS. 1 and 2 can be achieved. Furthermore, since the outlet bending roller 6 and the water collection device 12*a* are interconnected by the frame 40, they can be raised and lowered by a common cylinder 41. In this embodiment, it is not necessary to raise or lower the inlet roller 5*a*, and therefore the mechanism is more simple than the embodiment of FIGS. 1 and 2.

The roller arrangement shown in FIG. 5 may be modified as shown in FIG. 6, with a fixed roller 42 between the outlet bending roller 6 and the outlet pinch roller 4. This simplifies the passage of the strip 2 of hot rolled steel, hence the bending at the pinch roller 4 is reduced.

Again, as in the embodiment in FIGS. 1 and 2, the bending rollers 5*a* and 6 are held in the position shown in FIG. 5 when the strip 2 is being rolled, and the lowering of the outlet bending roller 6 may be determined according to the tension of the strip of hot rolled steel, so that further rollers, such as looper rollers, are not required.

Of course, as illustrated, one descaling header and one water collecting device is associated with each bending roller, but further descaling headers may be provided if necessary to supply additional water. Furthermore, although illustrated with two units, (each having a bending roller, descaling header, and water collecting device) further units may be provided if necessary.

The present invention has been devised particularly for use in a mini hot strip mill, but the descaling device of the present invention can be applied to a standard hot strip rolling mill, as even in a standard system, machine milling can be performed with a temperature drop less than is normal, so that a high quality can be obtained. The present invention can also be applied to a cold strip mill.

According to the present invention, it becomes possible to achieve effective scale removal from a strip of rolled material with a small temperature drop, so that high quality milling can be achieved. If the rolled material is thin, and moving at low speed, it is still possible to ensure that any temperature drop in that material is small, and this is particularly important when the invention is applied to a mini hot strip mill. As a result, satisfactory finishing milling can be achieved using an economical arrangement. Furthermore, effective scale removal can be achieved without generating contact flaws in the rolled material. Further reductions in production cost can be achieved since the pressure and amount of injected water can be reduced, as compared with known arrangements.

What is claimed is:

1. A descaling device for a strip of material, comprising:

means for bending and strip including a bending roller at a first predetermined point, means for vertically adjusting said bending roller with respect to said strip;

a water injection device for injecting water onto said strip to remove scale, said injection device being arranged to inject water at a second predetermined point spaced from said first predetermined point on one side of said first predetermined point; and collecting means for collecting said injected water including a collecting surface that is spaced from the surface of the strip and positioned to overhang an extension line extending beyond said first predetermined point in a direction opposite to a path of travel of said strip followed after said first predetermined point, and said collecting means being on the opposite side of said first predetermined point from said second predetermined point.

2. A descaling device according to claim 1, wherein said bending means comprises a pair of rollers.

3. A descaling device according to claim 1, having means for withdrawing said means for bending said strip from contact with said strip.

4. A descaling device according to claim 1, wherein said water injection device is arranged to inject said water towards said predetermined point.

5. A descaling device for a strip of material comprising:

means for bending said strip with a bending roller at a first predetermined point;

a water injection device for injecting water onto said strip, said water injection device being arranged to inject said injected water at a second predetermined point spaced from said first predetermined point on one side of said first predetermined point; and collecting means for collecting said injected water including a collecting surface that is spaced from the surface of the strip and positioned to overhang an extension line extending beyond said first predetermined point in a direction opposite to a path of travel of said strip followed after said first predetermined point, and said collecting means being on the opposite side of said first predetermined point from said second predetermined point.

6. A descaling device for a strip of material, comprising:

means for bending said strip with a bending roller at a predetermined point;

a water injection device for injecting water onto said strip; and collection means for collecting said injected water, said collection means having a water reception surface located adjacent, and spaced from, said strip adjacent said first predetermined point and positioned to overhang an extension line extending beyond said predetermined point in a direction opposite to a path of travel of said strip followed after said predetermined point.

7. A descaling device according to claim 6, wherein said water reception surface is spaced from said predetermined point by a distance not greater than 100 mm.

8. A descaling device for a strip of material, comprising:

means for bending said strip at a predetermined point with a bending roller;

a water injection device for injecting water onto said strip and further for injecting water onto said strip so that it separates from said strip at said predetermined point; and collection means for collecting said water which has separated from said strip including a collecting surface that is spaced from the surface of the strip and positioned to overhang an extension line extending beyond said predetermined point in a direction opposite to a path of travel of said strip followed after said predetermined point.

9. A descaling device for a strip of material comprising:

a roller for causing said strip to bend at a first predetermined point;

a water injection device for injecting water onto said strip on the opposite side of said strip from said roller, said water injection device being arranged to inject said injected water at a second predetermined point spaced from said first predetermined point; and collection means for collecting said injected water, said collection means being spaced from the first predetermined point and including a collecting surface that is spaced from the surface of the strip and positioned to overhang an extension line extending beyond said first predetermined point in a direction opposite to a path of travel of said strip followed after said first predetermined point, and said collection means being on the opposite side of said first predetermined point from said second predetermined point.

10. A device for treating a strip of material with water, said device comprising:

means for bending said strip at a first predetermined point with a bending roller, a water injection device for injecting water onto said strip, said water injection device being arranged to inject said injected water at a second predetermined point spaced from first predetermined point on one side of said predetermined point; and collection means for collecting said injected water, said collection means being spaced from the first predetermined point and including a collecting surface that is spaced from the surface of the strip and positioned to overhang an extension line extending beyond said first predetermined point in a direction opposite to a path of travel of said strip followed after said first predetermined point, and said collection means being on the opposite side of said first predetermined point from said second predetermined point.

11. A descaling system comprising a pair of descaling devices, each of said descaling devices comprising:

bending means including a bending roller for bending said strip at a first predetermined point, a water injection device for injecting water onto said strip to remove scale, said water injection device being arranged to inject said injected water at a second predetermined point spaced from said first predetermined point on one side of said first predetermined point; and collection means for collecting injected water, said collection means being spaced from the first predetermined point and including a collecting surface that is spaced from the surface of the strip and positioned to overhang an extension line extending beyond said first predetermined point in a direction opposite to a path of travel of said strip followed after said first predetermined point, and said collection means being on the opposite side of said first predetermined point from said second predetermined point.

12. A descaling system according to claim 11, wherein said water injection device and said collection means of one of said pair of descaling devices is on one side of said strip and said water injection device and said collection means of the other of said pair of descaling devices is on the opposite side of said strip.

13. A descaling system according to claim 11, further including means for simultaneously withdrawing said collection means of one of said pair of descaling devices and said bending means of the other of said pair of bending devices.

14. A method of descaling a strip of material comprising:

injecting water onto said strip to remove scale, said water being injected onto said strip at a first predetermined point;

bending said strip with a bending roller at a second predetermined point spaced from said first predetermined point; and collecting said injected water at a third predetermined point spaced from said second predetermined point with a collecting device having a collecting surface, including positioning said collecting surface to overhang an extension line extending beyond said second predetermined point in a direction opposite to a path of travel of said strip followed after said second predetermined point, said second predetermined point being between said first predetermined point and said third predetermined point.

15. A method according to claim 14, wherein said bending bends said strip through an angle between 10° and 35°.

16. A method according to claim 14, wherein said water is injected onto said strip in a direction towards said second predetermined point.

17. A method of descaling a strip of material comprising:

injecting water onto said strip of material;

bending said strip at a predetermined point with a bending roller so that said bending causes said water to separate from said strip at said predetermined point; and collecting said water which has been separated from said strip with a collecting device having a collecting surface positioned to overhang an extension line extending beyond said predetermined point in a direction opposite to a path of travel of said strip followed after said predetermined point.

18. A hot rolling mill for rolling a strip of heated material, said rolling mill including a descaling device for descaling said strip, said descaling device comprising:

means for bending said strip at a first predetermined point with a bending roller;

a water injection device for injecting water onto said strip to remove scale, said water injection device being arranged to inject said injected water at a second predetermined point spaced from said first predetermined point on one side of said first predetermined point; and collection means for collecting said injected water, said collection means being spaced from the first predetermined point and including a collecting surface that is spaced from the surface of the strip and positioned to overhang an extension line extending beyond said first predetermined point in a direction opposite to a path of travel of said strip followed after said first predetermined point, and said collection means being on the opposite side of said first predetermined point from said second predetermined point.

19. A hot rolling system for rolling a strip of heated material, said rolling system including:

at least one roughing mill for rolling said strip;

at least one finishing mill for rolling said strip; and a descaling device for descaling said strip, strip descaling device being located between said at least one rough roller and said at least one finishing roller and comprising:

means for bending said strip at a first predetermined point with a bending roller;

a water injection device for injecting water onto said strip to remove scale, said water injection device being arranged to inject said injected water at a second predetermined point spaced from said first predetermined point on one side of said first predetermined point; and collection means for collecting said injected water, said collection means being spaced from the first predetermined point and including a collecting surface that is spaced from the surface of the strip and positioned to overhang an extension line extending beyond said first predetermined point in a direction opposite to a path of travel of said strip followed after said first predetermined point, and said collection means being on the opposite side of said first predetermined point from said second predetermined point.

20. A hot rolling system for rolling a strip of heated material, said rolling system including a pair of coilers for reversibly rolling said strip therebetween, and a descaling device for descaling said strip, said descaling device being located between said pair of coilers and comprising:

means for bending said strip at a first predetermined point;

a water injection device for injecting water onto said strip to remove scale, said water injection device being arranged to inject said injected water at a second predetermined point spaced from said first predetermined point on one side of said first predetermined point; and collection means for collecting said injected water, said collection means being spaced from the first predetermined point and including a collecting surface that is spaced from the surface of the strip and positioned to overhang an extension line extending beyond said first predetermined point in a direction opposite to a path of travel of said strip followed after said first predetermined point, and said collection means being on the opposite side of said first predetermined point from said second predetermined point.

21. A process of rolling a strip of heated material, said method including descaling said strip by injecting water onto said strip to remove scale, said water being injected onto said strip at a first predetermined point;

bending said strip with a bending roller at a second predetermined point spaced from said first predetermined point; and collecting said injected water at a third predetermined point spaced from said second predetermined point with a collecting device having a collecting surface, including positioning said collecting surface to overhang an extension line extending beyond said second predetermined point in a direction opposite to a path of travel of said strip followed after said second predetermined point, and said second predetermined point being between said first predetermined point and said third predetermined point.

22. A process according to claim 21, wherein said strip is of steel.

* * * * *